US007308907B2

(12) United States Patent
Ouyoung

(10) Patent No.: US 7,308,907 B2
(45) Date of Patent: Dec. 18, 2007

(54) INDUCTION FLUSH DEVICE

(75) Inventor: Crystal Ouyoung, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 478 days.

(21) Appl. No.: 11/055,690

(22) Filed: Feb. 11, 2005

(65) Prior Publication Data

US 2006/0179560 A1 Aug. 17, 2006

(51) Int. Cl.
*F16L 5/00* (2006.01)

(52) U.S. Cl. ..... 137/360; 251/129.04

(58) Field of Classification Search ..... 251/129.04–129.06; 137/360
See application file for complete search history.

(56) References Cited

U.S. PATENT DOCUMENTS 5,253,670 A * 10/1993 Perrott ..... 137/360
5,555,907 A * 9/1996 Philipp ..... 137/360
6,085,780 A * 7/2000 Morris ..... 137/360
2003/0102448 A1* 6/2003 Parsons ..... 251/129.04
2004/0164261 A1* 8/2004 Parsons et al. ..... 251/129.04
2006/0169938 A1* 8/2006 Woo ..... 251/129.04

* cited by examiner

*Primary Examiner*—Eric Keasel
*Assistant Examiner*—Cloud Lee
(74) *Attorney, Agent, or Firm*—Troxell Law Office, PLLC

(57) ABSTRACT

The present invention discloses an induction flush device connecting water supply and a toilet bowl. The induction flush device includes a tank, a fixing board, a flush valve set and a panel. The panel is mounted on a side of the tank. The flush valve set is mounted on the fixing board. The tank forms a first guiding element thereon, and the fixing board forms a second guiding element thereon for cooperating with the first guiding element, thereby the fixing board is movable relative to the tank. The flush valve set includes an anti-reverse valve, an electromagnetic valve, a flexible inlet pipe for connecting with the water supply, and a flexible outlet pipe for draining water to toilet bowl. The flush valve set is movable relative the tank with the fixing board for repairing or replacement.

10 Claims, 6 Drawing Sheets

INDUCTION FLUSH DEVICE

BACKGROUND OF THE INVENTION

1. Field of the Invention

The present invention relates to an induction flush device, and particularly to an induction flush device for flushing a toilet bowl.

2. Related Art

Induction flush devices are often used to automatically flush toilet bowls, such as urinals and squat pans.

In prior art, wall-embedded induction flush device normally has a tank embedded at a predetermined position on a wall, a chamber provided in the tank, and a flush valve set. An inlet pipe is connected with an end of the flush valve set for supplying water, and an outlet pipe is connected with another end of the flush valve set for draining water to flush the toilet bowl.

The flush valve set consists of an anti-reverse valve and an electromagnetic valve. The anti-reverse valve connects with the inlet pipe. The electromagnetic valve has an end connecting with the outlet pipe and electrically connecting with an external infrared induction source.

The external infrared induction source is arranged at a cover of a front side of the tank. The infrared induction source activates the electromagnetic valve after use, and then water flows through the outlet pipe to flush the water bowl.

Although the flush valve set automatically flush a toilet bowl, it has to be removed from the chamber of the tank when the flush device needs to be repaired. In order to reduce volume and manufacture cost, the chamber of the tank has dimension nearly fit for size of the flush valve set. In a whole, the flush device is troublesome to be repaired, even some components thereof cannot be repaired or replaced.

SUMMARY OF THE INVENTION

Accordingly, an object of the present invention is to provide an induction flush device which is easily repaired and maintained.

To achieve the above object, the induction flush device of the present invention comprises a tank, and a flush valve set mounted on a fixing board. The tank defines a chamber therein. A first guiding element is formed on the tank and accommodated in the chamber. The fixing board is accommodated in the chamber, and forms a second guiding element thereon for corresponding to the first guiding element thereby guiding the fixing board to transversely move relative to the tank without displacement. The flush valve set includes an anti-reverse valve, an electromagnetic valve, a flexible inlet pipe and a flexible outlet pipe. The anti-reverse valve and the electromagnetic valve connect with each other. The inlet pipe has an end connecting with the anti-reverse valve and another end connecting with water supply. The outlet pipe has an end connecting with the electromagnetic valve and another end connecting with a toilet bowl.

The first guiding element is stamped from a bottom of the tank and has two rows of inverted L-shaped tracks which are opposing to each other. The second guiding element is integrally formed on the fixing board and has L-shaped cross section for fitting with the first guiding element.

DESCRIPTION OF THE PREFERRED EMBODIMENTS

Figure 1:
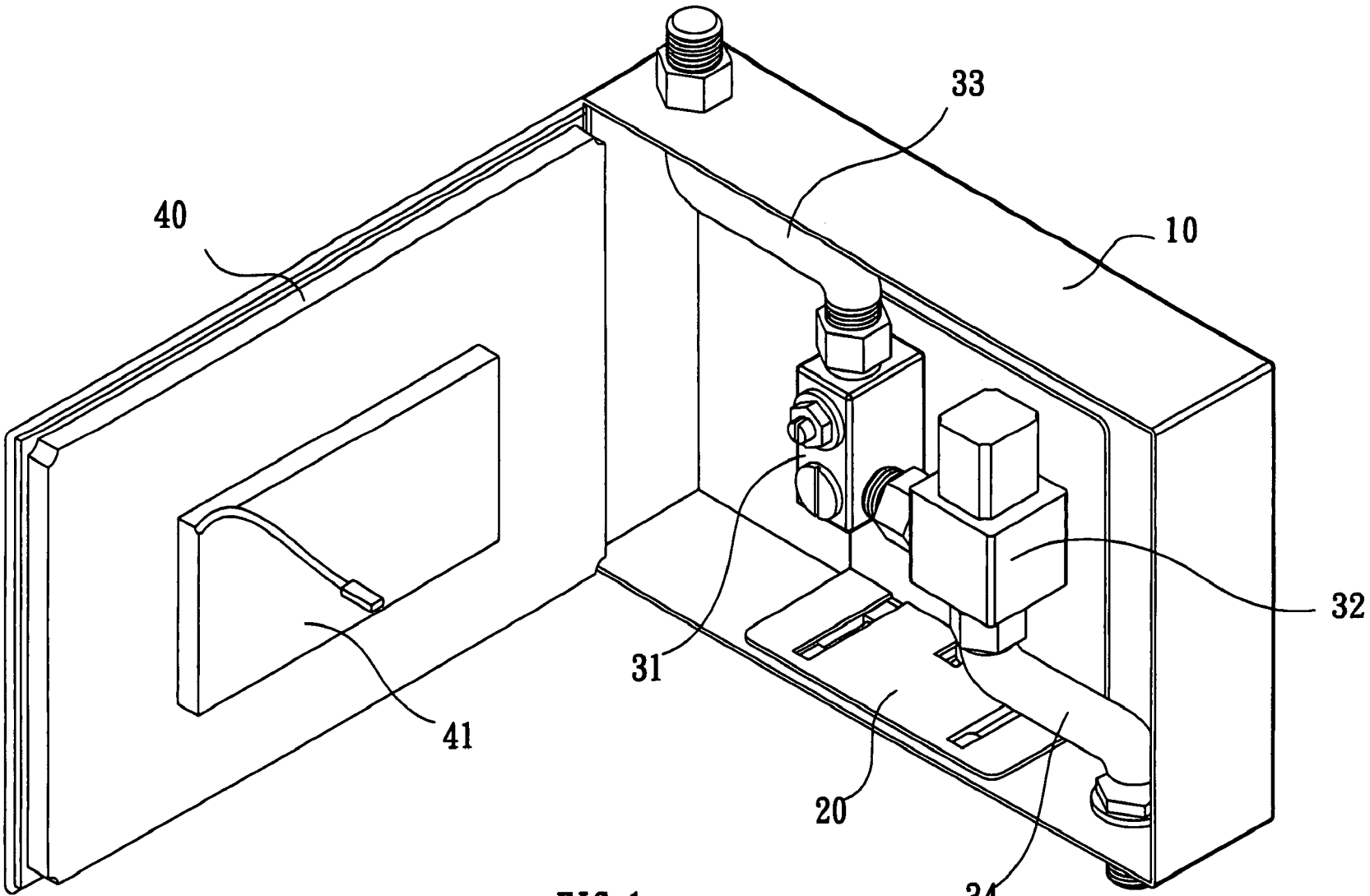
FIG. 1 is an assembled view of an induction flush device according to the present invention.
Figure 2:
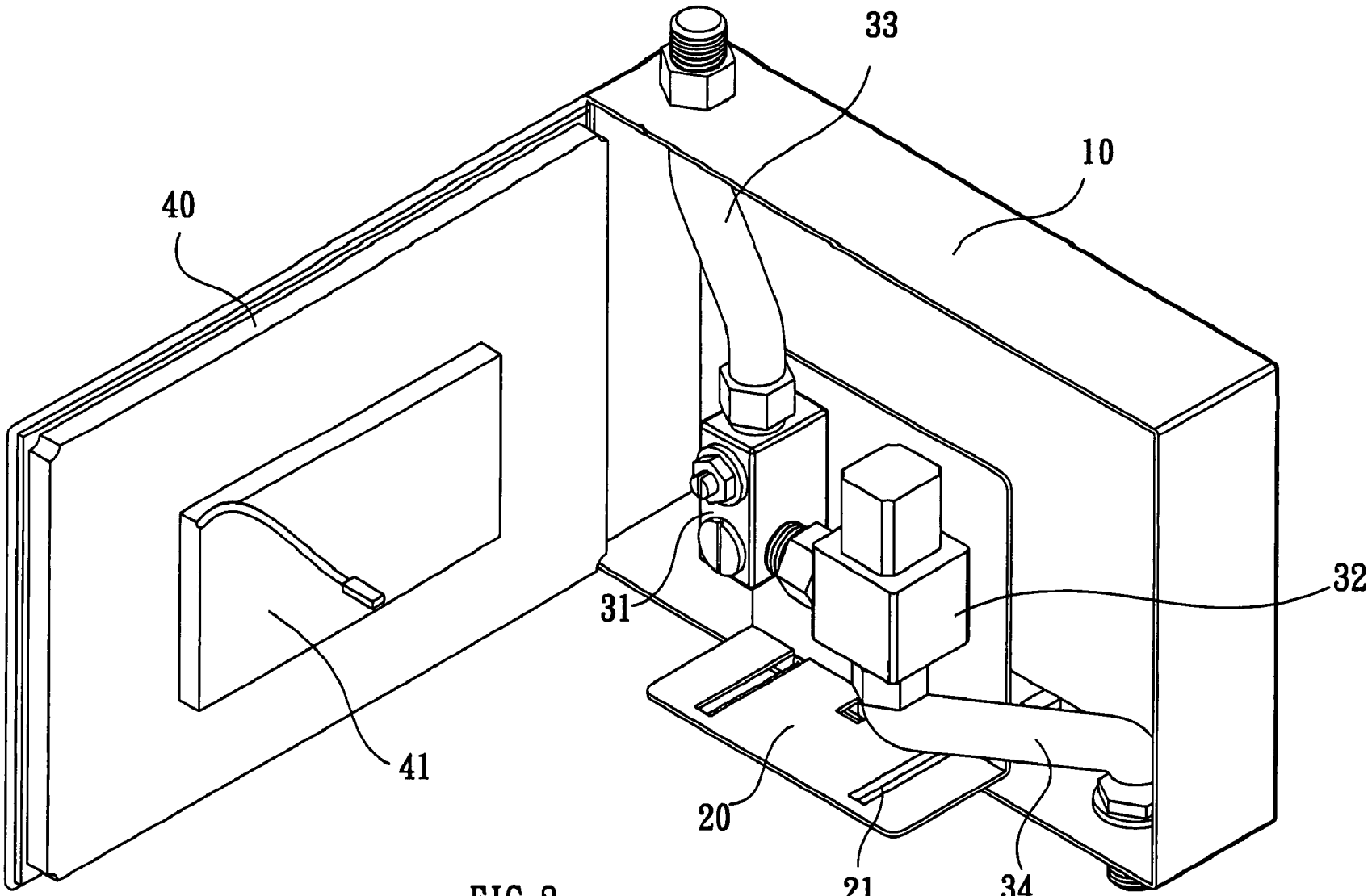
FIG. 2 is another assembled view of FIG. 1.
Figure 3:
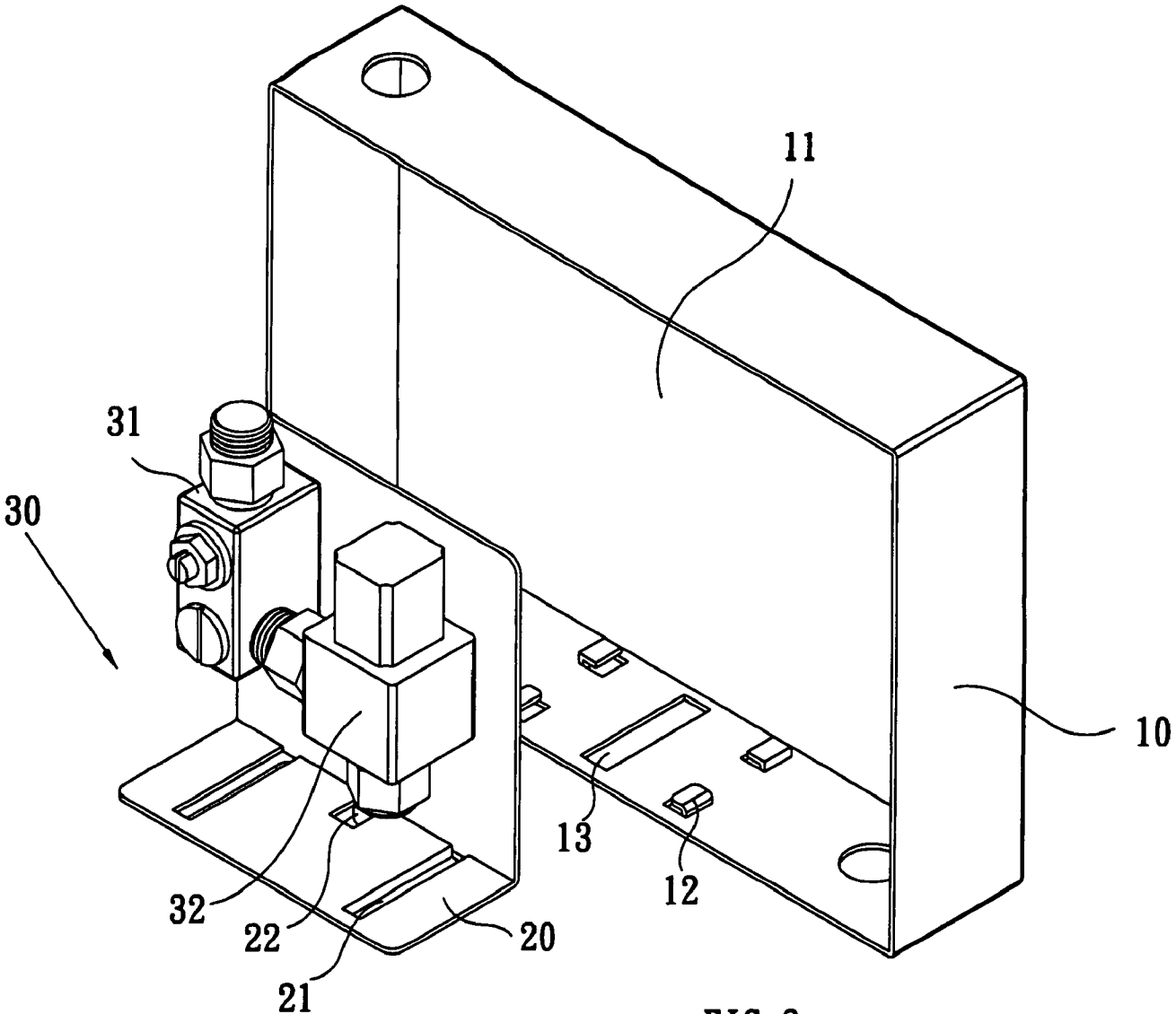
FIG. 3 is an exploded view of the induction flush device of FIG. 1.
Figure 4:
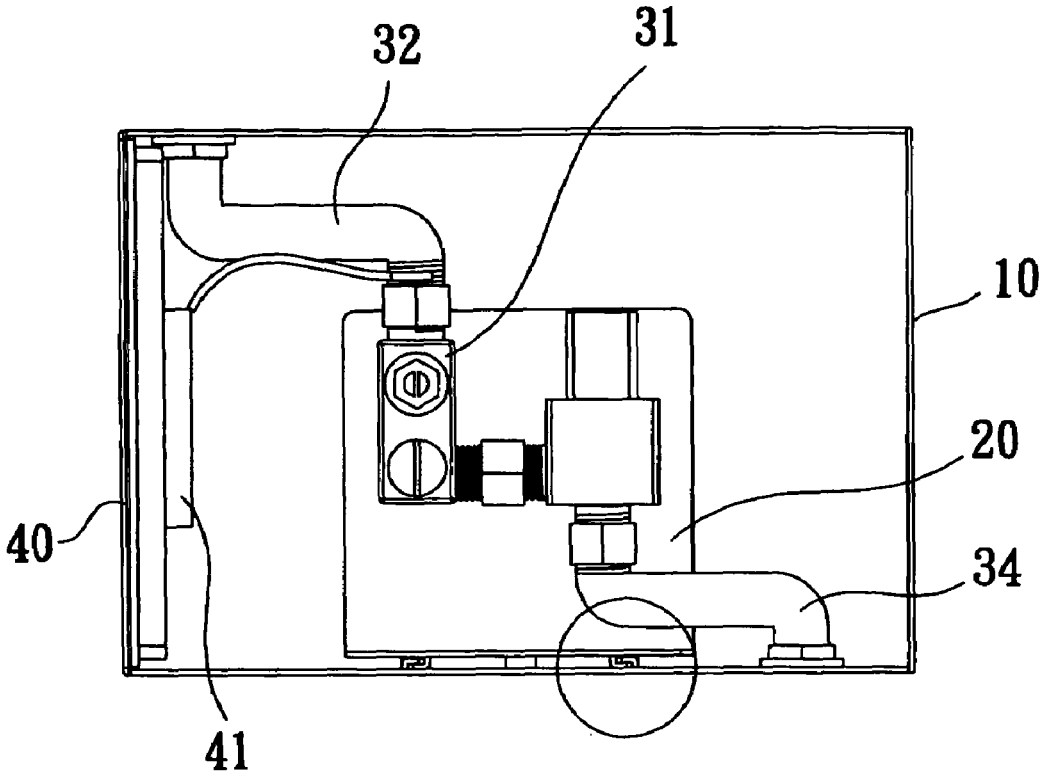
FIG. 4 is a front view of the induction flush device of FIG. 1.
Figure 5:
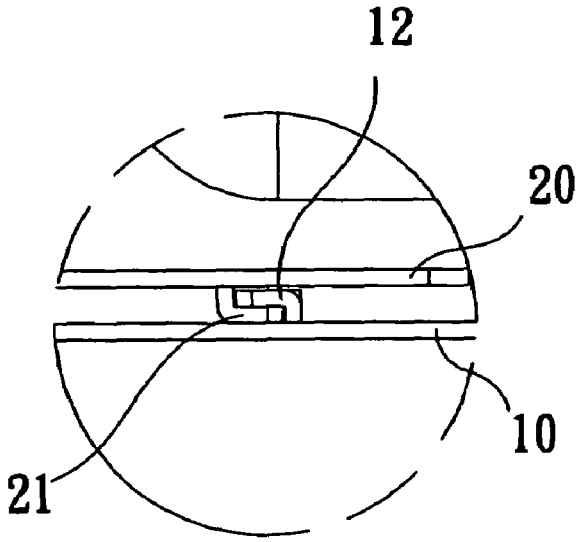
FIG. 5 is an enlarged view of the encircled portion in FIG. 4.
Figure 6:
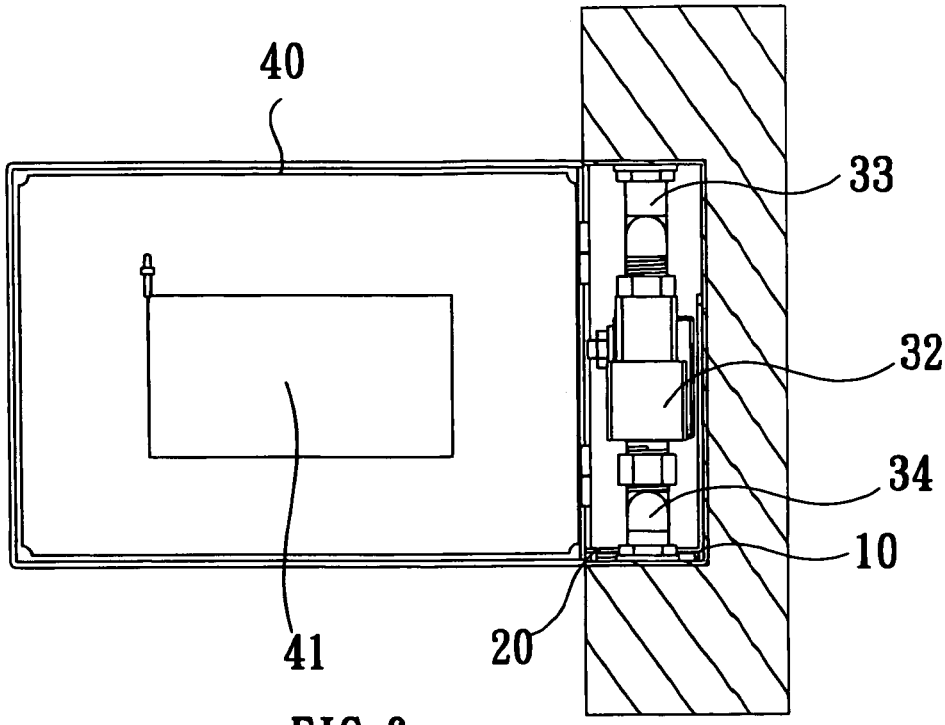
FIG. 6 is a schematic cross-sectional view of the induction flush device.
Figure 7:
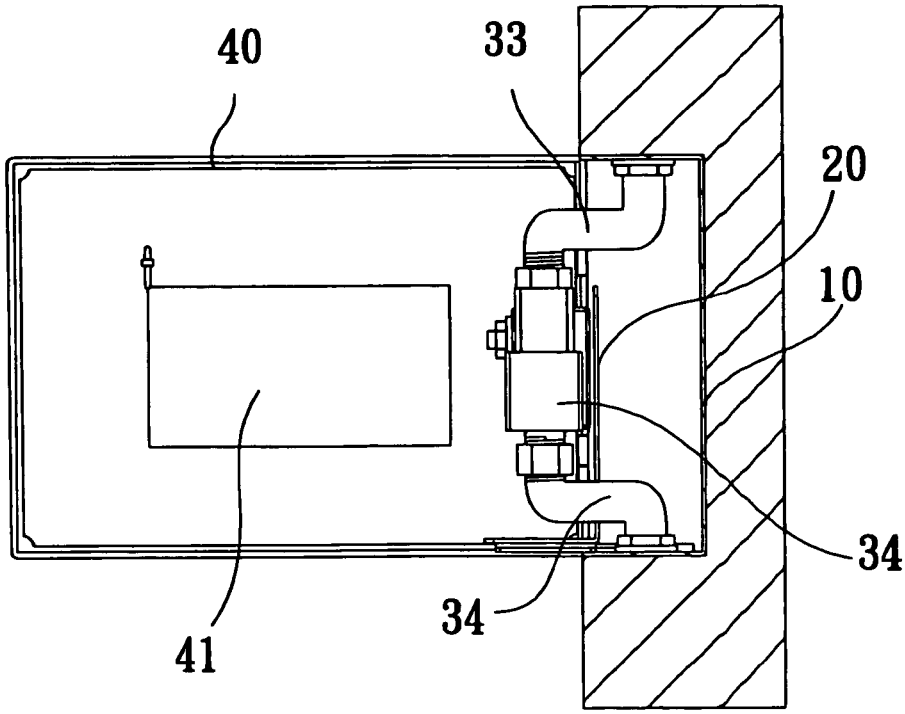
FIG. 7 conceptually shows a flush valve set of the induction flush device is pulled out.

With reference to FIGS. 1 to 6, an induction flush device 1 in accordance with the present invention comprises a tank 10, a fixing board 20, a flush valve set 30 and a panel 40. The tank 10 is embedded onto a wall and defines an opening (not labeled) at a side thereof and a chamber 11 therein. A first guiding element 12 is integrally formed at a bottom of the tank 10 and is accommodated on the chamber 11. The first guiding element 12 has inverted L-shaped cross section. In this embodiment, the first guiding element 12 has two rows of inverted L-shaped tracks which are stamped from a bottom of the tank 10 and are opposing to each other. Each row of inverted L-shaped track of the first guiding element 12 has two inverted L-shaped blocks. The fixing board 20 is accommodated in the chamber 11. A second guiding element 21 is integrally formed on the fixing board 20 and has L-shaped cross section for fitting with the first guiding element 12. The second guiding element 21 has two rows of L-shaped tracks which are opposing to each other for cooperating with the inverted L-shaped tracks of the first guiding element 12. The fixing board 20 is transversely slidable relative to the tank 10 along the first guiding element 12 without displacement. A guiding slot 13 is defined in a bottom of the tank 10 and between the inverted L-shaped tracks of the first guiding element 12. The guiding slot 13 has appropriate length lower than width of the tank 10. A stop 22 is stamped downwardly from the fixing board 20 and is slidable in the guiding slot 13 thereby resisting the first guiding element 12 disengagement from the second guiding element 21.

The flush valve set 30 is mounted on the fixing board 20 and comprises an anti-reverse valve 31, an electromagnetic valve 32, an inlet pipe 33 and an outlet pipe 34. The inlet valve 33 and the outlet valve 34 are made of flexible material. The anti-reverse valve 31 and the electromagnetic valve 32 are respectively fixed on the fixing board 20 and connect with each other. The inlet pipe 33 has an end connecting with the anti-reverse valve 31, and another end connecting with water supply (not shown). The outlet pipe 34 has an end connecting with the electromagnetic valve 32, and another end connecting with a toilet bowl (not shown).

The panel 40 is mounted on the opening of the tank 10. An induction sensor 41 is formed on the panel 40 and electrically connects with the electromagnetic valve 32. In this embodiment, the induction sensor 41 is an infrared induction sensor.

Figure 8:
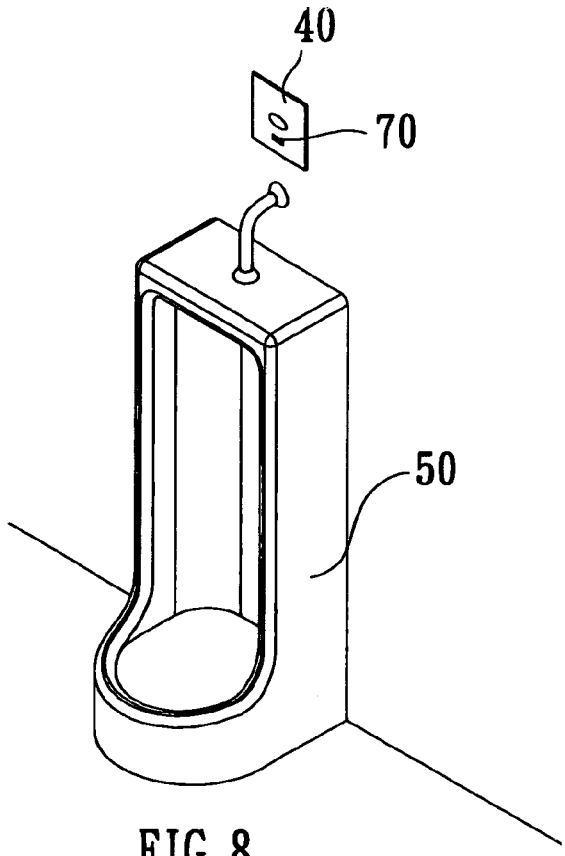
FIG. 8 conceptually shows the induction flush device mounted on a urinal.
Figure 9:
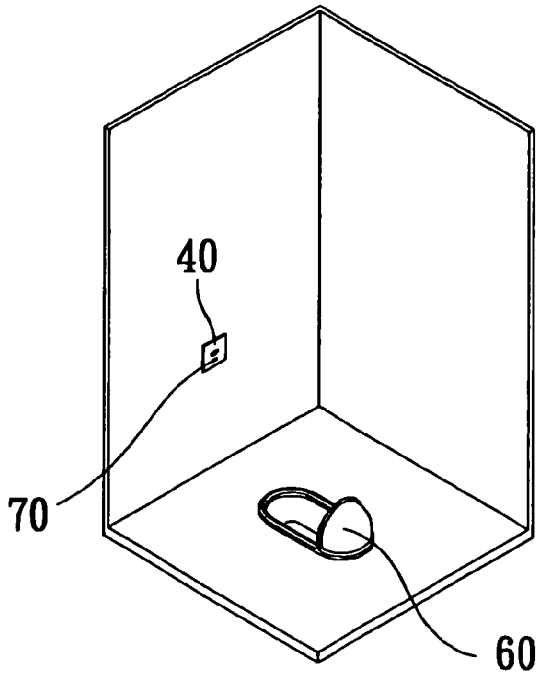
FIG. 9 conceptually shows the induction flush device mounted on a squat pan.

Further referring to FIGS. 8 and 9, the induction flush device 1 may be assembled with a urinal 50 or a squat pan 60. The induction sensor 41 on the panel 40 activates the electromagnetic valve 32 when detecting use of the urinal 50 or the squat pan 60. Meanwhile water flows through the outlet pipe 34, and automatically flushes the toilet bowl of the urinal 50 or the squat pan 60.

Combining with FIGS. 2 through 7, when the flush valve set 30 needs to be repaired, a user may directly open the panel 40, and move the fixing board 20 outward from the chamber 11 via the first guiding element 12 and the second guiding element 21. Correspondingly, the anti-reverse valve 31 and the electromagnetic valve 32 move outside the tank 10 with the fixing board 20, facilitating the user to replace or repair the anti-reverse valve 31, the electromagnetic valve 32 and a filtering net (not shown). In addition, the inlet pipe 33 and the outlet pipe 34 are flexible, and therefore are free to extend or bend when the fixing board 20 moves relative to the tank 10.

Referring to FIGS. 8 and 9, an encryption lock 70 is formed on the panel 40 for locking the panel 40 with the tank 10 after repairing, thereby avoiding theft and destroying.

It is understood that the invention may be embodied in other forms without departing from the spirit thereof. Thus, the present examples and embodiments are to be considered in all respects as illustrative and not restrictive, and the invention is not to be limited to the details given herein.

The invention claimed is:

1. An induction flush device, adapted for connecting water supply and a toilet bowl, comprising:

a tank defining a chamber therein and an opening at a side thereof, and a first guiding element being formed on the tank and accommodated in the chamber;

a fixing board being accommodated in the chamber, and forming a second guiding element thereon for cooperating with the first guiding element thereby guiding the fixing board to transversely move relative to the tank without displacement;

a flush valve set being mounted on the fixing board, and including an anti-reverse valve, an electromagnetic valve, a flexible inlet pipe and a flexible outlet pipe, wherein the anti-reverse valve and the electromagnetic valve connecting with each other, the inlet pipe having an end connecting with the anti-reverse valve and another end connecting with the water supply, the outlet pipe having an end connecting with the electromagnetic valve and another end connecting with the toilet bowl; and a panel being assembled on the opening of the tank, an induction sensor being formed on the panel and electrically connecting with the electromagnetic valve.

2. The induction flush device as claimed in claim 1, wherein the first guiding element is stamped from a bottom of the tank and has two rows of inverted L-shaped tracks which are opposing to each other.

3. The induction flush device as claimed in claim 2, wherein each row of inverted L-shaped track of the first guiding element has two inverted L-shaped blocks.

4. The induction flush device as claimed in claim 2, wherein the second guiding element is integrally formed on the fixing board and has L-shaped cross section for fitting with the first guiding element.

5. The induction flush device as claimed in claim 4, wherein the second guiding element has two rows of L-shaped tracks which are opposing to each other.

6. The induction flush device as claimed in claim 2, wherein a guiding slot is defined in a bottom of the tank and between the inverted L-shaped tracks of the first guiding element.

7. The induction flush device as claimed in claim 6, wherein a stop is stamped downwardly from the fixing board and is slidable in the guiding slot.

8. The induction flush device as claimed in claim 6, wherein the guiding slot has an appropriate length lower than width of the tank.

9. The induction flush device as claimed in claim 1, wherein the induction sensor is an infrared induction sensor.

10. The induction flush device as claimed in claim 1, wherein an encryption lock is formed on the panel.

* * * * *